United States Patent [19]

Shinohara et al.

[11] 4,105,444

[45] Aug. 8, 1978

[54] AIR FLOW METHOD OF CLEANING ION MODULATION PHOTOSENSITIVE SCREEN DURING CORONA CHARGING

[75] Inventors: Yukimasa Shinohara, Yokohama; Katsunobu Ohara, Kawasaki; Yujiro Ando, Yokohama, all of Japan

[73] Assignee: Canon Kabushiki Kaisha, Tokyo, Japan

[21] Appl. No.: 729,692

[22] Filed: Oct. 5, 1976

[30] Foreign Application Priority Data

Oct. 15, 1975 [JP] Japan ..... 50-124002

[51] Int. Cl.[2] ..... G03G 13/00; G03G 15/02; G03G 15/22

[52] U.S. Cl. ..... 96/1 R; 96/1 E; 355/3 SC

[58] Field of Search ..... 96/1 R, 1 E; 355/3 SC; 118/650

[56] References Cited

U.S. PATENT DOCUMENTS

| | | | |
|---|---|---|---|
| 3,647,291 | 3/1972 | Pressman et al. | 96/1 R UX |
| 3,779,166 | 12/1973 | Pressman et al. | 101/426 |
| 3,797,926 | 3/1974 | Fotland et al. | 355/3 SC |
| 3,977,323 | 8/1976 | Pressman et al. | 355/3 SC X |

FOREIGN PATENT DOCUMENTS

| | | | |
|---|---|---|---|
| 2,508,104 | 8/1975 | Fed. Rep. of Germany | 355/3 SC |

*Primary Examiner*—John T. Goolkasian
*Attorney, Agent, or Firm*—Fitzpatrick, Cella, Harper & Scinto

[57] ABSTRACT

In an electrophotographic method using a screen-like photosensitive medium having a number of fine openings to effect image formation, an air stream directed toward corona discharge means is maintained in the openings of the screen-like photosensitive medium when the corona discharge means, at least during the process of latent image formation, is in operation.

19 Claims, 11 Drawing Figures

AIR FLOW METHOD OF CLEANING ION MODULATION PHOTOSENSITIVE SCREEN DURING CORONA CHARGING

BACKGROUND OF THE INVENTION

1. Field of the Invention

This invention relates to an electrophotographic method using a screen-like photosensitive medium having a number of fine openings (hereinafter referred to as the screen), and more particularly to such a method which enables good formation of images.

2. Description of the Prior Art

In a conventional electrophotographic method, an electrostatic latent image is formed by a predetermined process on a photosensitive medium in the form of a plate comprising superposed layers, whereafter the latent image is developed and the developed image is transferred onto paper or other transfer medium. On the other hand, the photosensitive medium is cleaned after the image transfer by cleaning means such as a brush or a blade member, to remove any unnecessary developer therefrom in preparation for another cycle of image formation. Such conventional cleaning means intensely rubs the surface of the photosensitive medium, thus resulting in damage to and reduced durability of such surface.

Also, the conventional electrophotography which involves the step of cleaning has accordingly required a space available for the cleaning step, to be provided adjacent to the photosensitive medium, and the cleaning means which has a complicated mechanism in itself has led to complication of the entire image formation apparatus. To overcome the problems concerning the durability of the conventional photosensitive medium and the complication of the apparatus, there is a method known as the transfer of electrostatic image (TESI). In this TESI method, the latent image on the photosensitive medium is transferred onto a transfer medium, and then the transfer medium is developed to form a visible image. Thus, the photosensitive medium is not subjected to development and this eliminates the need to provide the cleaning means for the photosensitive medium, and accordingly eliminates the possibility of reduced durability of the photosensitive medium which would otherwise result from the friction imparted thereto and this has raised the expectation of increased service life of the photosensitive medium. However, the TESI method is disadvantageous in that the final image formed thereby is faster to reduce its quality than the final image formed by the conventional electrophotographic method using the cleaning means. Such an unexpected phenomenon may be considered attributable to the corona discharge imparted to the photosensitive medium during the formation of the latent image. More particularly, substances produced by the corona discharge and dust or like materials in the air are deposited on the photosensitive medium and since these substances and dust or like materials are moisture-absorbent or electrically conductive, they seem to reduce the electrical resistance on the surface of the photosensitive medium and prevent the electrostatic latent image from being formed with a sufficiently high potential. Other various electrophotographic methods are known which use a screen but which do not need the cleaning means for the photosensitive medium, as in the core of above-described TESI method. These electrophotographic methods are disclosed, for example, in U.S. Pat. No. 3,680,954, U.S. Pat. No. 3,582,206, U.S. Pat. No. 3,645,614 and U.S. application Ser. No. 480,280, filed June 17, 1974, now abandoned, wherein the primary electrostatic latent image formed on the screen is not developed but ion flows are modulated by the latent image to thereby form a secondary electrostatic latent image on a recording medium. These electrophotographic methods whereby the image formation is achieved by ion flows being modulated by the use of a screen do not need the use of the cleaning means and therefore, a phenomenon similar to that peculiar to the TESI method occurs in an image formation apparatus having no cleaning means.

To prevent any reduction in electrical resistance of the surface of the photosensitive medium occurring in the above-described TESI method, there is known a method of applying conventional cleaning means to the photosensitive medium or a method of supplying silicone oil to the surface of the photosensitive medium and further cleaning such surface likewise. According to these methods, the reduction in electrical resistance of the photosensitive medium may be prevented to some extent, but the reduction in durability of the photosensitive medium resulting from the friction imparted thereto by the cleaning means is unavoidable. Of course, application of cleaning means to the electrophotographic method using a screen would also be conceivable, whereas direct application of conventional cleaning means would be difficult. More specifically, the substrate of the screen is formed by a net of metallic fine wire or by a relatively deformable blank shaped by electrotyping a sheet of metal and this offers a problem of whether or not the screen itself can withstand the friction imparted thereto by the cleaning means or whether or not the openings of the screen can be cleaned as well.

SUMMARY OF THE INVENTION

It is a primary object of the present invention to prevent any reduction in electrical resistance of the surface of a screen used in the electrophotographic method.

It is another object of the present invention to prevent any reduction in said electrical resistance without the screen itself being subjected to any friction and to realize enhanced durability of the screen.

It is still another object of the present invention to minimize the reduction in electrical resistance of the screen surface and maintain the screen surface at a high resistance state to thereby form a primary latent image with a high potential of electrostatic charge.

It is yet another object of the present invention to modulate a flow of ions by the primary latent image so formed and to form a secondary latent image with a high electrostatic contrast.

It is a further object of the present invention to modulate the ion flows a plurality of times by a single latent image formed on the screen when in its high resistance state to thereby form an image.

The present invention which solves the above-noted problems peculiar to the prior art and achieves the above objects will hereinafter generally be described.

According to the present invention, as long as corona discharge means is effecting corona discharge in the region where it lies at least during the process of primary electrostatic latent image formation, an air stream directed toward the corona discharge means is maintained in the openings of the screen. Where the corona discharger is disposed in opposed relationship with the screen, the space on that side at which the corona discharger exists is rendered to a lower pressure state than the space on the opposite side with respect to the screen, so that as long as the corona discharger is in operation, an air stream directed toward the corona discharger is maintained in the openings of the screen. If the screen is constructed into a tubular form by the use of a drum-shaped support member, such support member is substantially hermetically sealed by a shield wall member and an air pressure differential is provided between the interior and the exterior of the drum-shaped screen within the shield wall member so that as long as the corona discharge means is in operation at least during the process of primary electrostatic latent image formation, an air stream directed toward the discharge means is maintained in the openings of the screen. The primary electrostatic latent image herein mentioned refers to a latent image formed on the screen corresponding to an image original, and the secondary electrostatic image refers to a latent image formed on a chargeable member by modulating ion flows by the primary electrostatic latent image. In the foregoing, minimum essentials of the present invention have been mentioned, but it is to be understood, for example, that during image formation, the air stream directed toward the discharge means may at all times be maintained in the openings of the screen.

The invention will become more fully apparent from the following detailed description of some embodiments taken in conjunction with the accompanying drawings.

DESCRIPTION OF THE PREFERRED EMBODIMENTS

Figure 1:
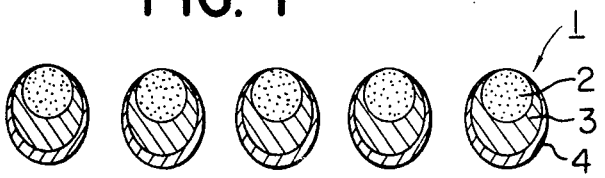
FIG. 1 is an enlarged cross-sectional view of an embodiment of the screen used with the present invention.

FIGS. 1 to 5 show an example of the screen used with the present invention, but this is not the only screen which is usable with the invention. The shown screen is described in detail in our U.S. application Ser. No. 480,280, and herein only the process of latent image formation by using such screen will be simply explained. FIG. 1 is a schematic, enlarged cross-sectional view depicting an example of the screen which is usable with the present invention. In FIG. 1, the screen 1 comprises an electrically conductive member 2 having a number of fine passage openings, and a photoconductive member 3 and an insulating member 4 successively laid over the conductive member. FIGS. 2 to 5 illustrate the process of forming a primary and a secondary electrostatic latent image by the use of the screen shown in FIG. 1. The photoconductive member 3 is shown with respect to an example which has such a characteristic that positive pores are introduced into the photoconductive member even in the dark portion thereof. More specifically, the photoconductive member 3 is a semiconductor whose main carrier comprises positive pores such as Se or its alloy.

Figure 2:
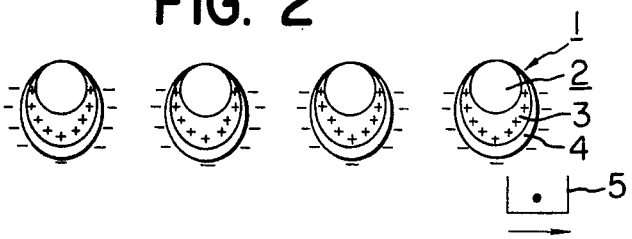
FIGS. 2 to 4 illustrate the formation of a primary electrostatic latent image by the use of the screen shown in FIG. 1.
Figure 3:
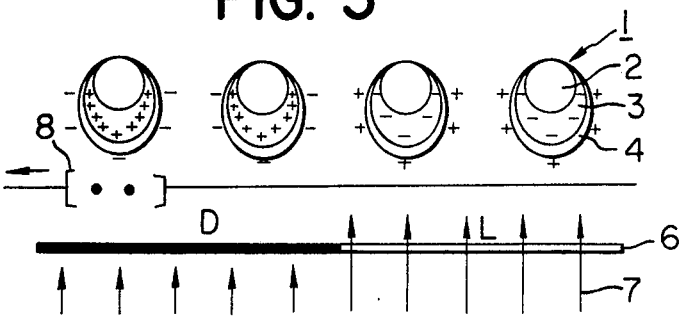
Figure 4:
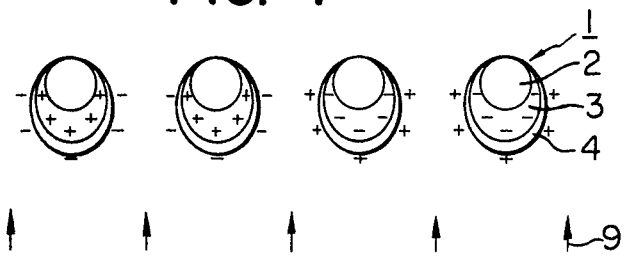
Figure 7:
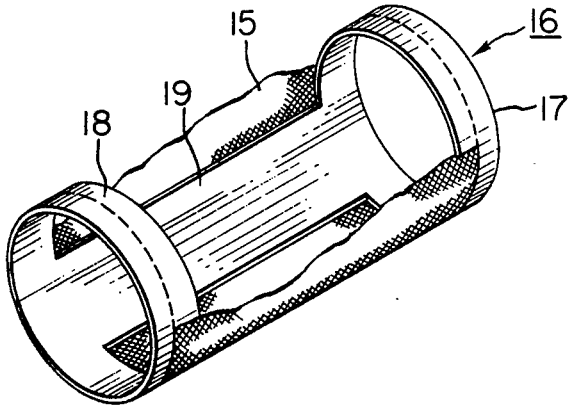
FIG. 7 is a perspective view of a frame body for the screen.

FIG. 2 particularly shows the result of the application of a primary voltage to the screen. The insulating member of the screen 1 is uniformly charged to the negative polarity (−) by known charging means. By such charging, the positive pores are introduced from the conductive member 2 into the photoconductive member 3 and captured in the interface adjacent to the insulating member 4. Designated by 5 is a corona charger. FIG. 3 shows the result of the substantially simultaneous application of a secondary voltage and image light to the screen. The secondary voltage application is effected by the use of corona discharge employing, as the voltage source, a voltage comprising an AC voltage with a bias voltage of the positive polarity (+) superimposed thereon. As such voltage source, use may also be made of a DC voltage opposite in polarity to the primary voltage. Also, the application of the secondary voltage and the application of the image light need not always take place simultaneously with each other but may take place in succession where the photoconductive member 3 is of a slow attenuation characteristic for the dark. In FIG. 3, reference character 6 designates an original to be copied, L and D denote light and dark regions, 7 denotes light rays and 8 a corona discharger. FIG. 7 shows the result of the all-over illumination applied to the screen 1. It is seen that the surface potential of the screen 1 rapidly changes to a potential proportional to the quantity of surface potential charge on the insulating member 4 only in the dark region, thus forming a primary electrostatic latent image. In FIG. 4, reference character 9 designates light rays from a light source means such as a lamp or the like.

Figure 5:
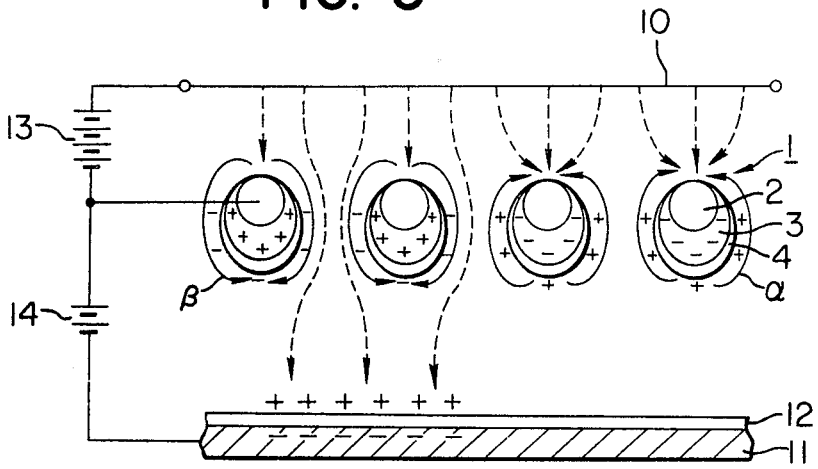
FIG. 5 illustrates the formation of a secondary electrostatic latent image.

FIG. 5 shows the manner in which ion flows are modulated by the above-described primary electrostatic latent image to form a secondary electrostatic latent image on a recording medium. In this Figure, reference character 10 denotes the corona wire of the discharger, 11 an opposed electrode member, and 12 the copy paper on a surface of which the secondary electrostatic latent image is formed. Designated by 13 and 14 is a power source portion for generating an electric field through which the corona ions may flow between the corona wire 10 and the copy paper 12. The copy paper 12 is disposed on that side which is adjacent to the insulating member 4 of the screen 1, and the ion flows are applied to the copy paper 12 through the corona wire 10 disposed with the screen 1 intervening between it and the copy paper. Thereupon, an electric field provided by the primary electrostatic latent image on the screen 1, namely, an electric field blocking the ion flow indicated by solid line $\alpha$, acts on the light region side of the image, while an electric field blocking the ion flow indicated by solid line $\beta$ acts on the dark region side of the image. By this, a secondary electrostatic latent image in the state of a positive image of the original is formed on the copy paper 12. The screen 1 of the present invention constructed as described above permits the primary electrostatic latent image to be formed on the insulating member, thereby extremely enhancing the electrostatic contrast provided by the quantity of charge of the latent image. Further, for the same reason, attenuation of the charge on the formed latent image may be minimized to enable the retention copying by which a multiplicity of copy images can be obtained from a single primary electrostatic latent image. The screen to which the present invention is applicable is not restricted to the shown one but may also be a two-layer screen comprising an electrically conductive member and a photoconductive member or an insulating member, or a four-layer screen, whereas description will further be made of the shown screen as an example.

When an image is formed by the use of the above-described screen, the screen itself is not subjected to the developing process and thus, the conventional cleaning means need not be applied. For the reason already described, however, the electrical resistance on the screen surface will be reduced to induce attenuation of the formed electrostatic latent image as the process of latent image formation is repeated. Particularly in the retention copying, modulation is effected a number of times unlike the single modulation normally effected for a single latent image. Therefore, a single primary electrostatic latent image must be retained for a long time and the above-noted reduction in the electrical resistance on the screen surface cause a serious problem in the image formation. Particularly in case of the screen, it has been found that the reduction in the surface electrical resistance (this phenomenon will hereinafter be simply referred to as deterioration) progresses in a very short time, as compared with the conventional photosensitive medium having no opening. Such deterioration would be construed to be attributable to the following reason. When the screen is charged to a potential of particular polarity as in the step of FIG. 2 or 3, charges of the same polarity will thereafter be accumulated on the screen surface to create thereon an electrical field which would prevent the screen surface from being further charged. Thus, the ions for charging will flow through the openings of the screen to the opposite side from the charged side. Especially, in a screen having the conductive member on the opposite side like the screen of the present invention, the ion flow will become active. Such ion flow will cause an air stream directed from the corona discharger through the screen to be produced in the openings of the screen, and some substances created by the corona discharge would accompany the air stream and be deposited on the screen. To sustain such reasoning, there is an empirical result that when the primary electrostatic latent image formation has been repeatedly effected with the openings of the screen covered by a metal plate or an insulating plate from the back side thereof, the speed of deterioration has been of the same degree as in the conventional photosensitive medium having no opening. The present invention conversely utilizes such a disadvantage peculiar to the screen to maintain, in the openings of the screen, the air stream directed from the screen to the corona discharger, thereby minimizing the progress of the aforementioned deterioration. The invention will further be described with respect to an embodiment thereof and by reference to the drawings.

Figure 6:
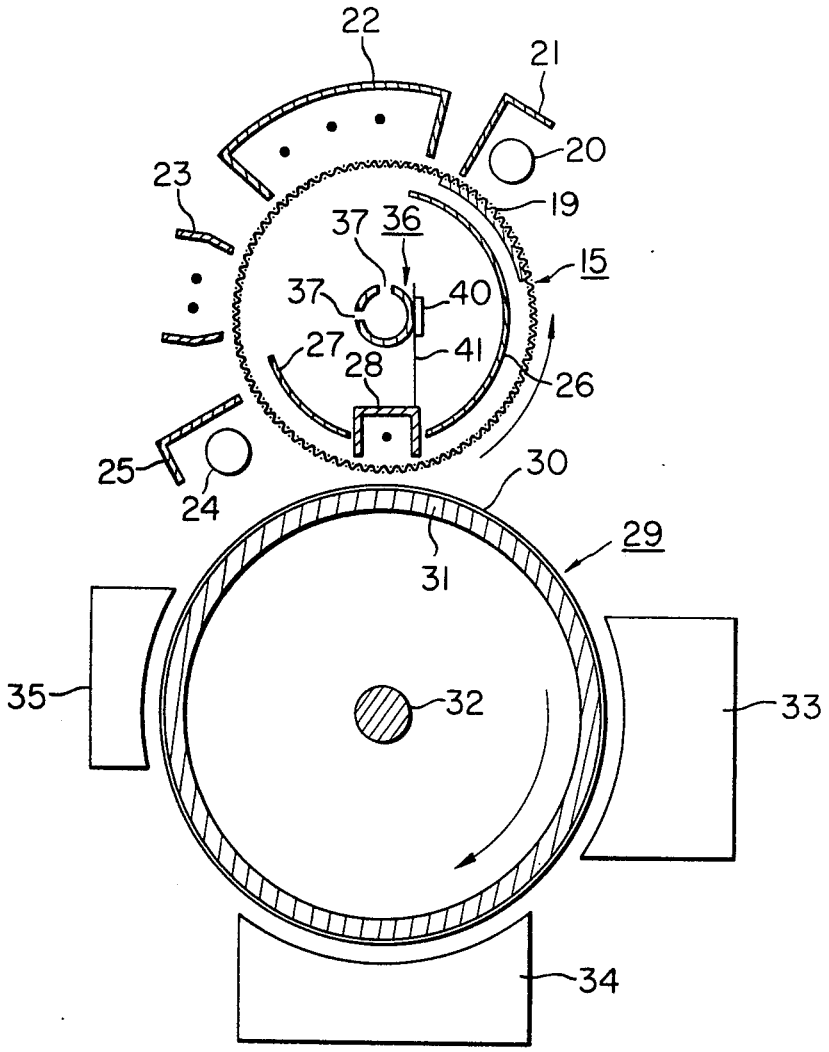
FIG. 6 is a schematic cross-sectional view of the image formation apparatus according to an embodiment of the present invention.

FIG. 6 schematically shows a cross-section of the image formation apparatus to which the present invention is applied. Designated by 15 is the screen which is identical to that described in connection with FIG. 1. The screen 15 is formed into a drum having its inner side provided by the exposed conductive member which is the substrate, and the drum is rotatable in the direction of arrow by unshown drive means. The formation of the screen 15 into such a drum shape may be accomplished as by using a drum-shaped frame body 16 comprising ring-shaped frame members 17 and 18 supported together by a joint member 19, as shown in FIG. 7. The screen 15 may be stretched over the periphery of the drum-shaped frame body 16 to thereby form the drum-shaped screen. The screen 15 so stretched may be secured to the frame body 16 as by providing an adhesive or like agent on the peripheral end portion of the screen 15. Around the drum-shaped screen 15, latent image formation means may be disposed adjacent thereto. Designated by 20 is pre-illuminating lamp for stabilizing the characteristic of the photoconductive member of the screen 15, and by 21 a light-intercepting plate for improving the effect of the illumination and preventing undesirable diffusion of light. Designated by 22 is a corona discharger for applying a primary voltage and 23 also denotes a corona discharger for applying a secondary voltage simultaneously with the application of image light. For this purpose, the back surface of the discharger 23 is made optically transparent. An all-over illumination lamp 24 is provided to sharply increase the potential of the primary electrostatic latent image, and a light-intercepting plate 25 similar to the light-intercepting plate 21 is disposed adjacent to the lamp 24. Within the drum-shaped screen 15, light-intercepting plates 26 and 27, for preventing the lights of the lamps 20 and 24 from reaching the portions of the screen to which the image light is applied, are formed in a partly cylindrical shape and securely disposed. A corona discharger 28 is provided within the drum-shaped screen 15 to apply corona ions therefrom to an underlying insulating drum 29 through the screen 15. When this occurs, the passage of the corona ion flows is controlled into the shape of the image by the primary electrostatic latent image on the screen 15, as a result of which a secondary electrostatic latent image may be formed on the insulating drum 29. The insulating drum 29 comprises an insulating surface layer 30, and an electrically conductive drum 31 which serves as the support for the insulating layer 30 and also as the opposed electrode for the discharger 28. Around the insulating drum 29, which is rotatable about its rotary shaft 32 in the direction of arrow and in synchronism with the screen 15, there are provided developing means 33, image transfer means 34 and cleaning means 35. For example, the secondary electrostatic latent image formed on the insulating drum 29 is developed by the developing means 33, whereafter the toner image obtained through the development is transferred to a recording member such as plain paper or the like by the image transfer means 34. Thereafter, the recording member is subjected to fixation by a heat roller or the like, while the insulating drum after the image transfer is discharged at the cleaning means 35 with the aid of AC corona discharge or a grounded electrode, and has unnecessary toner particles removed by a cleaning member in preparation for another cycle of latent image formation. The aforementioned corona discharger, developing means, image transfer means and cleaning means may be those which have been applied to the conventional electrophotographic method, and they need not be described further. When retention copying is to be effected with the present apparatus, the above-described process of secondary electrostatic latent image formation and subsequent processes may only take place with the primary electrostatic latent image formation means being stopped from operating.

A mechanism which is an embodiment of the present invention is provided within the drum-shaped screen 15 of the above-described image formation apparatus. In FIG. 6, a hollow shaft 36 situated at the center of the screen 15 is secured to the main body of the apparatus and provides a rotatable support shaft for the drum-shaped frame body 16. The shaft 36 has a plurality of openings 37 formed axially thereof, each of said openings 37 being situated to correspond to the position of the corona discharger for the secondary latent image formation. Air, preferably made free of dust and moisture by dust remover means, is supplied into the hollow of the shaft 36 from outside, so that the interior of the screen 15 is under a higher pressure than the exterior thereof. As a result, the air within the screen 15 may flow through the openings of the screen 15 to the exterior thereof. Of course, that side of the drum-shaped screen which is adjacent to the rotary shaft is hermetically sealed by a construction which will hereinafter be described. At least during the voltage application by the dischargers 22 and 23, if there is in the openings of the screen any air stream flowing toward these dischargers, the air stream would flow against dust or the like, being directed by the corona discharge applied for the purpose of charging, so that not only the portions of the screen which are adjacent to the dischargers but also the opening portions of the screen may be prevented from deteriorating. The air stream from the openings 37 may be supplied not only during the use of the dischargers but also at all times, and when rotation copying is desired with the present apparatus, the supply of said air may take place only during the primary electrostatic latent image formation. It has been found that the speed of deterioration of the screen to which the present invention has been applied is reduced to 1/10 to 1/1000 of that of a screen to which the present invention has not been applied, and this shows great effectiveness of the present invention. A more surprising fact is that even a screen to which the present invention has not been applied and already greatly deteriorated can be recovered from the deterioration to some extent if it is incorporated in the present apparatus and the invention is applied thereto. If such screen so recovered to some extent is kept from the application of the present invention, it again becomes as deteriorated as it was. From this fact, it is considered that such surprising phenomenon is effective to form an air stream passing through the openings of the screen to thereby remove some of the contaminants on the screen surface and in addition, render the screen into a state of being apparently less deteriorated. More specifically, the air stream flowing through the openings of the screen has a function of dehumidifying the screen to some extent, whereby the moisture in the screen may be removed to increase the electrical resistance of the screen, thus enabling a primary latent image with high potential to be formed thereon. Thus, the air stream flowing through the screen toward the corona applicator means may be regarded as having not only a dust-removing function but also a dehumidifying function. In this manner, the air stream of the present invention sufficiently performs the function of maintaining the electrical resistance of the screen at a high level and such an attempt has never been made in the electrophotography using a screen.

As will be appreciated, the present invention is effective not only to delay the progress of the screen deterioration but also to maintain the screen in an apparently less deteriorated state if the deterioration has progressed, and this is particularly effective for the electrophotography using a screen.

Figure 8:
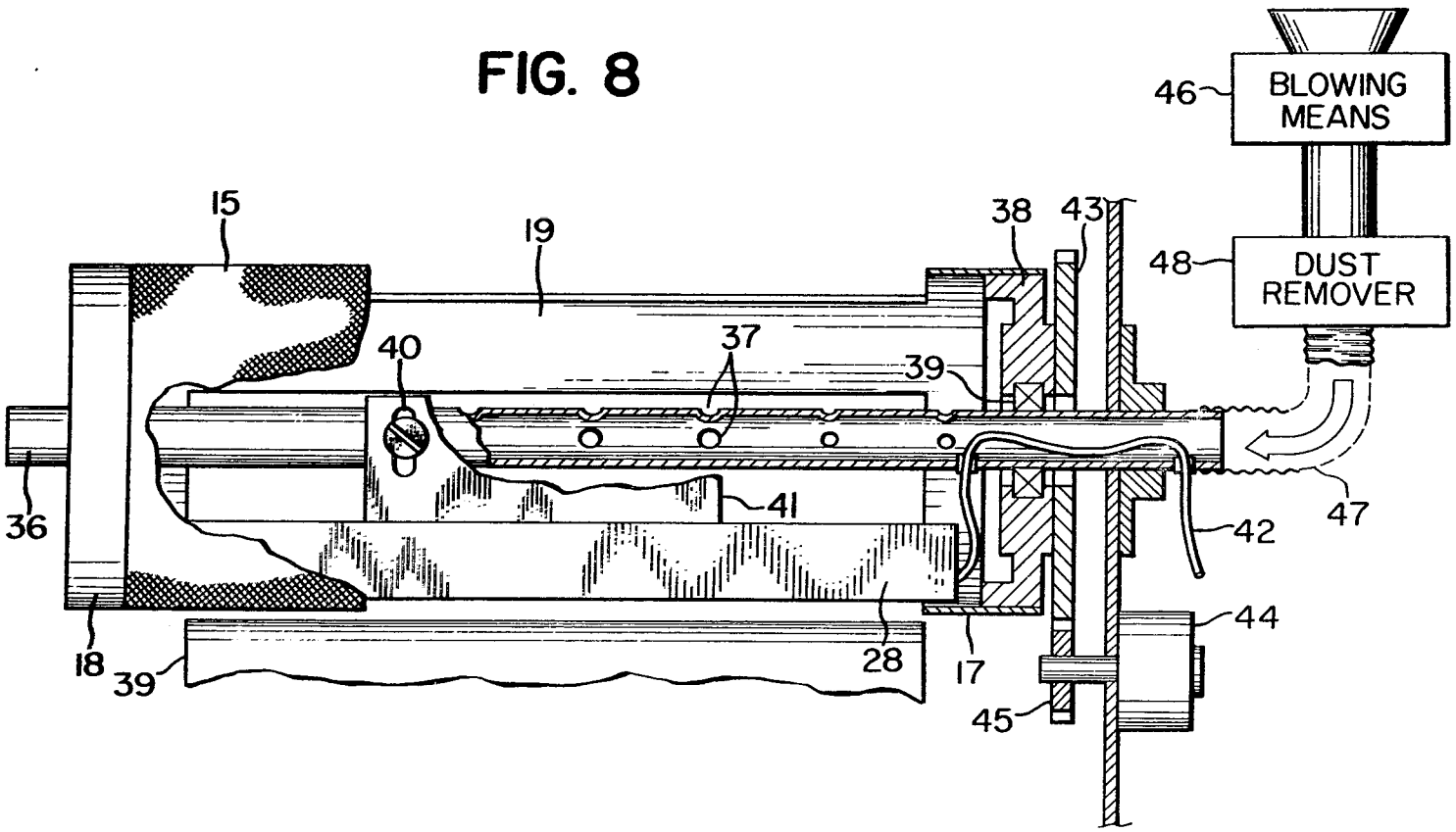
FIG. 8 is a transverse cross-sectional view of the screen and its adjacent portions of the FIG. 6 apparatus.

A specific construction of the FIG. 6 apparatus is illustrated in FIG. 8 which is a partly cross-sectional side view taken along the rotary shaft. In this Figure, the screen 15 is stretched over the drum-shaped frame body 16 of FIG. 7 which has one end rotatably journalled to a side plate 38 by means of a bearing 39 or the like. On the other hand, the modulating corona discharger 28 is fixedly supported on the shaft 36, independently of the frame body 16, by means of a support plate 41 and bolt or like fastening member, as shown. The position of the discharger 28 is adjustable by the above-described fixing mechanism. Power supply to the discharger 28 may be accomplished by a high tension line 42 which is passed through the hollow of the shaft 36. The frame body 16 over which the screen is stretched is rotatable by rotation of a gear 43 secured to the side plate 38 and meshing with a drive gear 45 which transmits the drive of a motor 44. The blast of air into the hollow shaft 36 is accomplished by directing pressurized air from blower means 46 to one end of the hollow shaft 36. More specifically, the pressurized air created by the blower means 46 provided with a fan member is directed into the hollow shaft 36 through a flexible pipe 47. Having reached the interior of the hollow shaft 36, the pressurized air flows inwardly of the screen 15 through the openings 37 of the shaft 36. Having so flowed inwardly of the screen 15, the pressurized air seeks a lower pressure portion and flows outwardly of the screen 15 therethrough. When flowing outwardly of the screen 15, the air in the openings of the screen 15 flows toward the dischargers disposed around and adjacent to the screen, so that during application of corona discharge to the screen 15, any dust and products resulting from the discharge cannot approach the screen surface and openings and these substances are never deposited on the screen. In order to ensure that the apparatus is used under proper condition the air taken into the blower means 46 should preferably be subjected to dust removal in advance. For example, the blower means 46 and the dust remover means 48 are connected together as shown, but in some cases, the sequence of connection may be converse to that of the shown embodiment. The dust remover means may be any of various types, the simplest one of which is to filtrate dust through a filter. However, such type of dust remover means can not be expected to remove fine dust or like particles and therefore, utilization of the electrical dust collection would also be effective. Since the electrical dust collection is a method of collecting dust by corona discharge, the undesirable products resulting from the discharge tend to be introduced into the screen 15 but, in the openings of the screen, the aforementioned air stream flows at a high speed against the flow of the discharger, in the direction from the inner side of the screen 15 to which corona is not applied, toward the outer side of the screen to which corona is applied. Thus, the products resulting from the discharge are prevented by the dust remover means from being deposited on the screen 15, thus eliminating the possibility of harm attributable to the above-noted type of contamination. The dust remover means is not restricted to those mentioned above, but chemical means are also available. For example, it will be effective to use a substance capable of adsorbing, solving or absorbing not only particulate noxious materials but also organic or inorganic gaseous noxious materials, or a substance capable of rendering these noxious materials, by chemical reaction and further having a catalytic effect of expediting the cracking of those noxious materials. Of course, it is also possible to enhance the dust removal effect by combining together these dust remover means which differ in principle.

Figure 9:
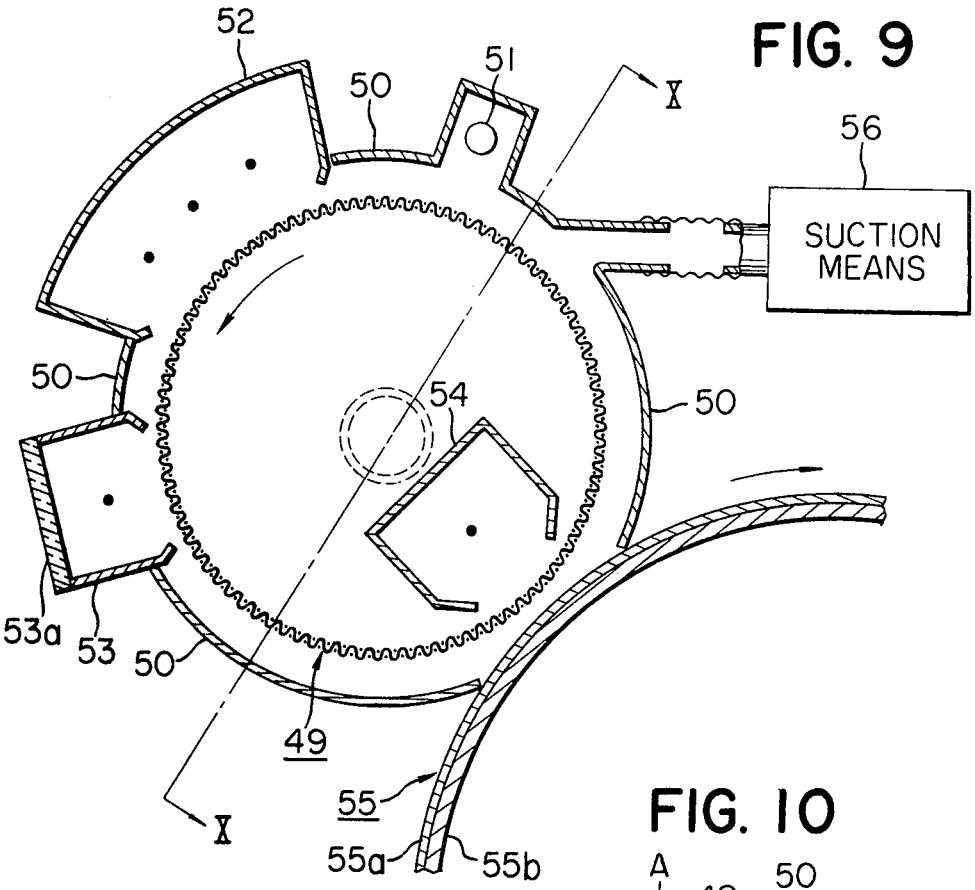
FIG. 9 is a cross-sectional view of the latent image formation portion in the image formation apparatus according to another embodiment of the present invention.

Another embodiment of the present invention will now be described by reference to the drawings. FIG. 9 shows the invention as applied to an image formation apparatus using the screen of FIG. 1. The embodiment of FIG. 9, unlike the embodiment of FIG. 6 in which an air stream flows from the interior of the screen toward the corona dischargers disposed around the screen, is in such a form that air is positively sucked from the corona discharger side. FIG. 9 shows a cross-section of the screen which is designated by 49 and formed into a drum shape by a frame body similar to that already described. Disposed around the screen 49 are primary electrostatic latent image formation means and an isolating plate 50 surrounding the screen 49. The primary latent image formation means includes, as viewed in the direction of rotation of the screen 49 indicated by arrow, a pre-illuminating lamp 51, a corona discharger 52 for applying a primary voltage and a corona discharger 53 for simultaneous application of a secondary voltage and image light. The back surface of the corona discharger is formed by glass 53*a*. The pre-illuminating lamp 51 serves also as an allover illumination lamp. Disposed within the screen 49 is a corona discharger 54, for the formation of the secondary electrostatic latent image, in opposed relationship with an insulating drum 55. The insulating drum comprises an insulating surface layer 55*a* and an electrically conductive drum 55*b* and is rotatable in the direction of arrow in synchronism with the screen 49.

Figure 10:
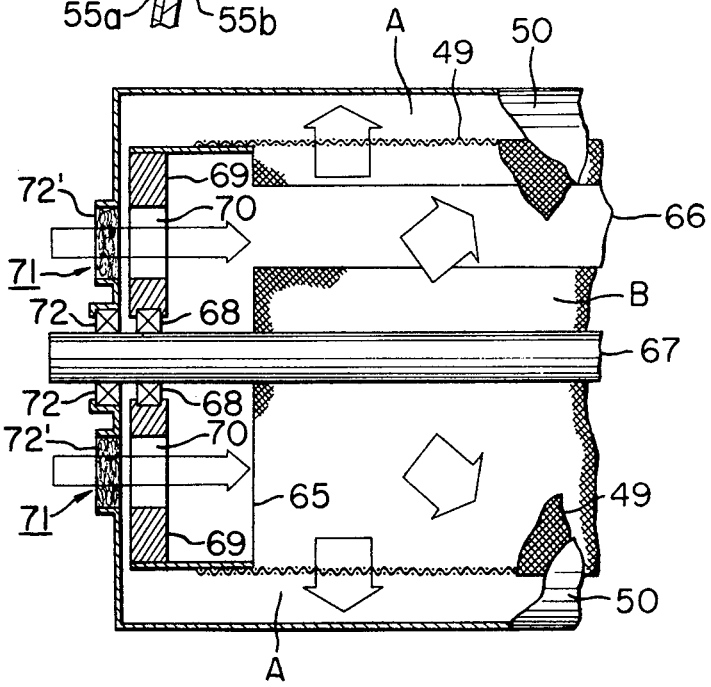
FIG. 10 is a cross-sectional view of one end portion taken along line 10—10 in FIG. 9.

With the screen 49 surrounded by the isolating plate 50 and the latent image formation means to isolate the screen 49 from the atmosphere, the air within the isolating plate 50 is sucked from a part of the isolating plate 50 by suction means 56. This condition will be described in detail by reference to FIG. 10, which shows one end portion of the screen 49 in a cross-section taken along line 10—10 of FIG. 9. The screen 49 is stretched over a frame body such as the frame body shown in FIG. 7. In FIG. 10, a ring-shaped frame body 65 and a joint member 66 correspond to the frame body 18 and the joint member 19, respectively, of FIG. 7. The screen 49 is rotatable by the mechanism as shown in FIG. 6. Designated by 67 is a rotary shaft secured to the apparatus body, and by 68 a bearing member which rotatably supports the flange member 69 of the screen 49 frame body with respect to the shaft 67. In the embodiment of FIG. 6, the flange member 69 is shown as a hermetically sealed mechanism, whereas in the present embodiment the flange member is formed with openings 70. Around the screen 49, the isolating plate 50 is disposed with a suitable clearance provided therebetween. The isolating plate 50 is secured to the rotary shaft 67 by means of bearing members 72, and portions of the side wall thereof form openings 71. In the above-described construction, as already noted in connection with FIG. 9, the air in the space A between the screen 49 and the isolating plate 50 is sucked by the suction means 56 (FIG. 9), so that the space A is rendered into a negative pressure state with respect to the inner space B. Thus, the air in the space B flows toward the space A. More specifically, there is created an air stream flowing from the inside of the screen 49 toward the corona discharge applying means. The arrows in FIG. 10 indicate such air stream. Further, filter means 72 may be provided across the openings 71 of the isolating plate 50, and air cleaned by dust remover means may be introduced into the openings 71.

Thus, it is possible to direct the air in a manner approximate to the method of the FIG. 9 embodiment, thereby preventing dust or like materials from being deposited on the opening portions of the screen. This method also may provide an effect approximate to that achieved by the FIG. 6 embodiment, but deposition of dust or like materials may also be prevented during the down time of the apparatus by the arrangement of the isolating plate surrounding the screen. Instead of the openings provided in the opposite ends of the screen, it is of course possible to dispose, within the screen, a hollow shaft leading to the outside of the isolating plate (as indicated by broken lines in FIG. 9), thereby uniformly imparting an air stream from the center of the screen.

Figure 11:
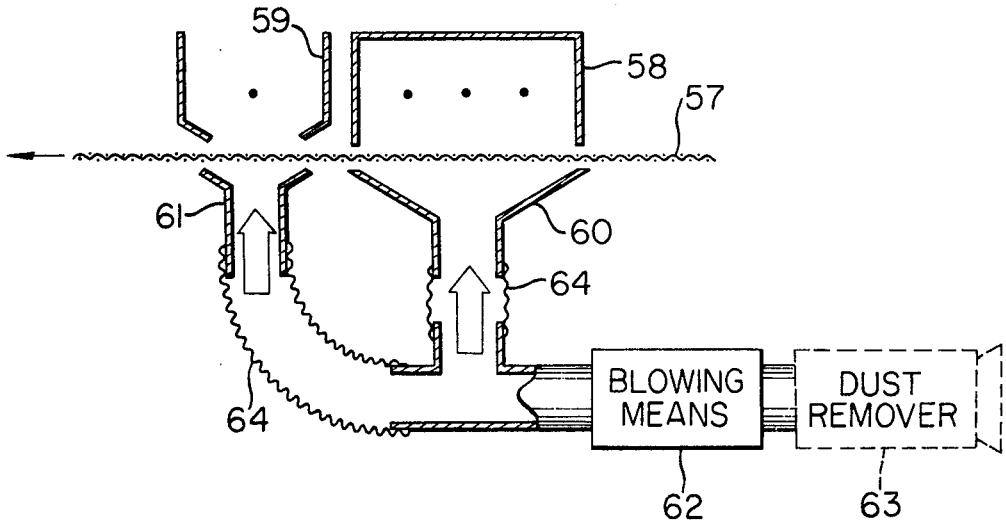
FIG. 11 is a partly cross-sectional view showing another embodiment of the air stream formation and the corona discharging portion.

FIG. 11 shows an embodiment in which an air stream flowing from the direction opposite to the corona discharger through the screen toward the discharger may be positively formed. This is somewhat different from the embodiment of FIG. 6 in which the air filling the interior of the drum-shaped screen flows outwardly through the openings of the screen toward the dischargers. More specifically, pressurized gas is injected through the screen toward the corona dischargers to thereby positively prevent the wind created by the corona discharge from flowing into the openings of the screen. In FIG. 11, reference numeral 57 designates the screen disposed so that its surface to be charged or discharged faces upwardly and a primary electrostatic image is formed on the screen as it is moved in the direction of arrow. The screen may of course be disposed up side down. Designated by 58 is the corona discharger for applying a primary voltage, and 59 the corona discharger for applying a secondary voltage. The back surface of the discharger 59 is provided with no shield plate so as to permit passage of the injected air therethrough. Disposed below the screen are injection nozzles 60 and 61 so as to correspond to said two dischargers, respectively, and compressed air is blown from blower means 62 into the nozzles 60 and 61 through a flexible pipe 54 at least during corona discharge. It will be apparent that the blower means 62 may be provided with dust remover means 63 such as the one already mentioned. Further, where the deterioration of the screen is attributable to the polarity of the corona discharge, a nozzle may be provided only for the discharger which discharges the corona of particular polarity which results in the deterioration of the screen. In this embodiment, it is unnecessary to form the screen into a hermetically sealed mechanism or to contain the screen within a hermetically sealed mechanism. Instead, a nozzle or nozzles may be disposed in opposed relationship with the discharger or dischargers and this will lead to the simplification of the construction. In the present embodiment, if suction means is particularly provided on the corona discharge side, the air stream may better pass through the openings of the screen.

Also, if the isolating plate is disposed along the direction of movement of the screen 57, deposition of dust or like materials may be prevented even when the screen 57 is not in motion. In FIG. 11, hollow arrows indicate the stream of compressed air.

According to the present invention, as has been described above, an air stream directed from the openings of the screen toward the source of corona discharge is created when the screen is subjected to the corona discharge by charging or discharging, whereby deterioration of the screen may be prevented. The mechanism for creating such air stream may produce the air stream flowing through the openings of the screen by forming a high pressure state or a low pressure state at one side of the screen. Also, according to the present invention, such air stream prevents the materials contained in the air or the products resulting from discharging from being deposited on the screen surface or the portions of the screen openings which are electrostatically charged or discharged. As a result, it is possible to minimize the deterioration of the screen and in addition, it is unnecessary to apply a friction or sliding type cleaning means to the screen, thus improving the durability of the screen. Further, the present invention is effective in that it enables good retention of charge to be maintained even on a screen for retention copying which is required to retain a primary electrostatic latent image continuously for a long time. Thus, the present invention overcomes the problems peculiar to the prior art screen and realizes the method of preventing deterioration of the screen. In the present invention, the screen has been illustratively shown as a three-layer screen which is covered by our previously filed application, whereas the screen construction and the latent image formation process are in no way restricted to those shown herein, but the present invention is applicable to the conventional screen as well as the screen on which a primary electrostatic latent image is formed by the use of corona discharge. Further, the air stream passing through the screen openings may be, for example, heated air for increasing the temperature of the screen to thereby dehumidify the screen and increase the electrical resistance of the screen surface, thus enabling the screen to be charged to a good potential. That is, the use of heating means in addition to the dust remover means used with the blower means will further be effective. In the foregoing embodiments, the corona discharger used to form a primary electrostatic latent image has been shown to be disposed only at one side of the screen, whereas depending on the screen construction, there are some cases where corona dischargers are disposed at the opposite sides of the screen. The present invention is also applicable to such dischargers.

What we claim is:

1. In a method of forming an electrostatic latent image on a photosensitive screen drum, which method includes applying corona discharge by a corona discharger to the photosensitive screen drum having a number of fine openings through its circumferential wall, the corona discharger being disposed in facing relationship with the outer surface of said screen drum, the improvement comprising:

providing a supply of air to the inside of said screen drum, via a longitudinal end of said screen drum, without passing said supply of air inwardly through the fine openings of said screen drum, and causing said supply of air to flow outwardly from the inside of the screen drum through the fine openings thereof, at least adjacent to and towards the corona discharger, to prevent foreign matter from being deposited on the screen drum while the corona discharger applies corona to said screen drum from the outside of said screen drum.

2. The method as set forth in claim 1, wherein the outwardly flowing air is limited to the area adjacent the corona discharger.

3. The method as set forth in claim 1, further comprising the step of treating said supply of air with dust removing means prior to providing said air to the inside of the drum.

4. The improvement as claimed in claim 1, further comprising the step of heating said supply of air prior to providing said air to the inside of the drum.

5. The method as set forth in claim 1, further comprising the steps of heating said supply of air and treating said air with dust removing means prior to providing said air to the inside of the drum.

6. The method as set forth in claim 1, wherein the step of providing said outward flow of air is performed by flowing the said air from a port disposed within said screen drum at a position opposed to the corona discharger.

7. The method as set forth in claim 6, wherein the screen drum is mounted on a hollow shaft and said port is provided in said shaft.

8. The method as set forth in claim 7, wherein said outwardly flowing air is provided by evacuating the air outside the screen drum to reduce the pressure outside the screen drum to a lower pressure than that at the inside thereof.

9. In a method of forming an electrostatic latent image on a photosensitive screen drum having a number of fine openings through its circumferential wall, which method includes applying corona discharge by a corona discharger to the photosensitive screen drum, the corona discharger being disposed in facing relationship with the outer surface of said screen drum, wherein the drum is completely enclosed at its circumference and both ends by isolation means, the improvement comprising:

introducing air to the inside of said screen drum, via a longitudinal end thereof without passing said air through the fine openings of said screen drum, and causing said air to flow outwardly, at least adjacent to and toward the corona discharger, from the inside of the screen drum through the fine openings thereof to prevent foreign matter from being deposited on the screen drum, while the corona discharger applies corona to said screen drum from the outside thereof.

10. The method as set forth in claim 9, further comprising the step of limiting the outwardly flowing air to the area adjacent the corona discharger.

11. The method as set forth in claim 9, wherein the step of causing the air to flow outwardly is performed by discharging said air through a port provided in a shaft of the screen drum.

12. The method as set forth in claim 11, further comprising the step of disposing the port in facing relation with said corona discharger through the circumferential wall of said screen drum.

13. The method as set forth in claim 11, wherein there is provided within the screen drum a corona discharger for modulating ion flow in accordance with an electrostatic latent image on the drum, and wherein the shaft is hollow and power is supplied to the inside corona discharger by passing a wire through the shaft.

14. In a method of forming an electrostatic latent image on a photosensitive screen drum having a number of fine openings through its circumferential wall, which method includes applying corona discharge by a corona discharger to the photosensitive screen drum, the corona discharger being disposed in facing relationship with the outer surface of said screen drum, wherein the drum is completely enclosed at its circumference and both ends by isolation means, the improvement comprising:

introducing air into inside of said screen drum, via a longitudinal end thereof without passing said air through the fine openings of said screen drum, and causing said air to flow outwardly, at least adjacent to and toward the corona discharger, from the inside of the screen drum through the fine openings thereof by sucking air from said isolating means, to thereby prevent foreign matter from being deposited on the screen drum, while the corona discharger applies corona to said screen drum from the outside thereof.

15. The method as set forth in claim 14, further comprising the step of limiting the outwardly flowing air to the area adjacent the corona discharger.

16. The method as set forth in claim 14, wherein the step of introducing air to the inside of the screen drum is performed by passing said air through ports provided at opposite longitudinal ends of the drum.

17. The method as set forth in claim 16, further comprising the step of providing said ports with means for removing dust from the air passing therethrough.

18. The method as set forth in claim 14, wherein the screen drum is mounted on a hollow shaft, and wherein the step of introducing air to the inside of the drum is performed by passing air through a port provided in the shaft of the screen drum.

19. The method as set forth in claim 14, wherein the screen drum is mounted on a hollow shaft, and wherein the step of introducing air to the inside of the drum is performed by passing air through a port provided in the shaft of the screen drum, and through ports provided at opposite longitudinal ends of the drum.

* * * * *